United States Patent [19]

Tajima

[11] 4,383,497

[45] May 17, 1983

[54] DEVELOPING DEVICE

[75] Inventor: Hatsuo Tajima, Matsudo, Japan

[73] Assignee: Canon Kabushiki Kaisha, Tokyo, Japan

[21] Appl. No.: 183,947

[22] Filed: Sep. 4, 1980

[30] Foreign Application Priority Data

Sep. 11, 1979 [JP] Japan ..... 54-116419

[51] Int. Cl.[3] ..... G03G 15/08

[52] U.S. Cl. ..... 118/651; 118/653; 355/3 DD

[58] Field of Search ..... 118/651, 653; 430/103, 430/120; 355/3 DD

[56] References Cited

U.S. PATENT DOCUMENTS 3,929,098 12/1975 Liebman ..... 118/653
4,076,857 2/1978 Kasper et al. ..... 430/103
4,187,330 2/1980 Harada et al. ..... 118/657 X
4,261,290 4/1981 Yamashita et al. ..... 118/658

*Primary Examiner*—Evan K. Lawrence
*Attorney, Agent, or Firm*—Fitzpatrick, Cella, Harper & Scinto

[57] ABSTRACT

A developing device of a construction including a magnetic device to form a magnetic brush with a magnetic carrier which charges and attracts single component, non-magnetic toner particles, a developer conveying device which receives the attracted toner particles through contact with the magnetic brush of the magnetic device, and leads the toner for development to a position confronting an electrostatic image holding member at a predetermined space interval, and a carrier passage inhibiting device, such as a device for applying an AC voltage between the magnetic device and developer conveying device, for providing movement of the toner to the conveying device while inhibiting movement of the carrier.

11 Claims, 6 Drawing Figures

DEVELOPING DEVICE

BACKGROUND OF THE INVENTION

1. Field of the Invention

This invention relates to a developing device, and, more particularly, it is concerned with a developing device incorporated in an image forming device such as electro-photographic apparatus, etc. and for developing an electrostatic image formed on an image holding member such as a photosensitive drum, etc.

As the developing method utilizing a single or one-component developing agent (or developer or toner), there have so far been known various sorts such as, for example, the powder clouding method, in which the toner particles are used in the atomized form; the contact method, in which a toner layer of a uniform thickness formed on a developing roller consisting of a web, sheet, or the like is caused to contact with the electrostatic image holding surface to thereby effect the development; the jumping method, in which the toner layer is positioned in confrontation to the electrostatic image holding surface without contact between them, and the toner particles are caused to selectively fly toward the image holding surface due to the electric field on the electrostatic image; the magne-dry method, wherein a magnetic brush is formed by using an electrically conductive magnetic toner, and this magnetic brush is caused to contact the electrostatic image holding surface to thereby effect the development; and other methods.

Of these various developing methods, the jumping method has been known as unique. This method is effected in such an arrangement that a developer is applied on a developer holding or conveying means in a thin layer, after which an electrostatic image surface is opposed to the front surface layer of this thinly applied developer.

In this arrangement, the developer is caused to fly, due to the electrostatic force of attraction, from the developer conveying means to the electrostatic latent image surface to effect the development (vide: U.S. Pat. No. 2,839,400 and No. 3,232,190). According to this jumping method, not only is the developer not attracted to the non-image portion having therein no latent image potential, but also the developer does not contact the non-image portion, hence a favorable development completely free from the ground fogging can be realized.

In view, however, of the fact that, at the time of the development, use is made of the flying phenomenon of the toner particles due to the electric field of the electrostatic image, the visible image obtained generally lacks sharpness at its edge portion, so that the resulting image is devoid of clearness. In the case of developing a linear image, it is developed thinner in appearance than its original, and in only an image poor in its tonality (due to steep gradation ($\gamma$) in the characteristic curve of the image density with respect to the electrostatic image potential).

The assignee of the present inventors have proposed new developing method in their U.S. patent applications Ser. No. 938,494, Nos. 938,101, 938,494 and No. 58,434, all abandoned, in which sharpness and tonality of the image, which have been the problems in the conventional jumping development, are improved.

The first two developing methods have characteristics such that a single component developer is uniformly applied onto a developer conveying means to form a thin, uniform layer of developer, and this thin developer layer is opposed to the electrostatic latent image forming surface with a small gap between them so that the outer surface of the developer layer is not in contact with the latent image forming surface, and then the development is effected by extending or stretching forth the developer confronting the image portion by its electrostatic force of attraction. Since the development by these methods is done under conditions where the developer is not in contact with the non-image portion, a sharp image free from the ground fogging can be obtained.

The second two methods are constructed in the same manner as in the above two methods, in addition to which an AC bias voltage is applied as a developing bias voltage across the thin developer layer and the electrostatic image forming surface, and a gap between the electrostatic latent image surface and the developer holding means is changed with lapse of time. According to this developing method, the developer is caused to reach even the non-image portion of the electrostatic latent image at the initial stage of the development so that development can be effected at a half tone portion, while the developer is caused to arrive at the image portion alone after a lapse of time. By this developing method, image development can be performed free from fogging, having sharpness in the resulting image, and giving extremely favorable reproducibility in the half tone.

In these developing methods, it is important that a thin layer of developer be uniformly coated on the developer conveying means. While one-component magnetic developer may easily be put into practical use, because it can be relatively easily controlled by the combined use of a magnetic means, with one-component, non-magnetic developer it is difficult to obtain a stable and favorable result. It has therefore been a practice so far that, in each of the above-mentioned developing methods, the one-component non-magnetic developer is fed onto the developer conveying means such as an ordinary developing roller, etc, and then the developer is charged by a frictional charging member, after which the developer holding means is disposed in confrontation to the electrostatic latent image surface.

However, when the toner quantity to be supplied to the developing roller is not constant, and the toner is fused and coagulated onto the frictional charging member and the developing roller surface due to wear of the frictional charging member and the developing roller caused by friction between them, there inevitably takes place irregularity in the toner application, whereby the electric charge quantity for the toner charging becomes irregular. Such irregularity reflects on the copy image in the form of an image irregularity at the time of the development.

Further, when the surface of the developing roller is made irregular with a view to holding the toner particle layer thereon, or when a toner holding surface layer includes a multitude of tiny holes distributed throughout, the toner particles which have been captured in the irregular surface or in the tiny holes are not easily charged, as a result of which the toner does not contribute to the development and the copy image obtained is inferior in its developing characteristics and is low in its image density.

SUMMARY OF THE INVENTION

The present invention has been made in view of the above-mentioned points of problems, and aims at providing a novel and excellent developing device.

Another object of the present invention is to provide a developing device which enables favorable development to be realized with use of a one-component, non-magnetic developer or toner.

Still another object of the present invention is to provide a developing device which can be used in a device for color image formation.

According to the present invention, in a general aspect thereof, there is provided a developing device which comprises magnetic means forming a magnetic brush with a magnetic carrier which attracts one-component, non-magnetic toner particles due to the electric charging; and a developer conveying means which receives the attracted toner by its contact with the magnetic brush of the magnetic means, and leads the toner particles to a position where it confronts an electrostatic latent image holding member at a predetermined space interval so that it may serve for the development. AC voltage applying means assists in the transfer of toner particles to the holding means.

The foregoing objects, other objects as well as the actual construction of the present invention will become more apparent from the following detailed description when read in conjunction with accompanying drawing showing a preferred embodiment thereof.

DESCRIPTION OF THE PREFERRED EMBODIMENTS

Figure 1:
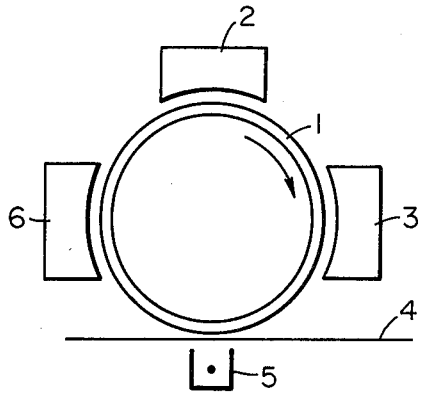
FIG. 1 is a schematic structural diagram of an actual image forming device, in which the developing device of the present invention is employed.

FIG. 1 is a schematic side view for explaining the actual construction of the image forming apparatus, in which the developing device of the present invention is incorporated.

In FIG. 1, a reference numeral 1 designates an electrostatic image holding member including a photo-semiconductive layer, 2 refers to an electrostatic image forming device including a charging device and an image exposure device, 3 a developing device according to the present invention, 4 a developed image transfer material, 5 an image transfer device, and 6 a cleaning device for the electrostatic image holding member.

Figure 2:
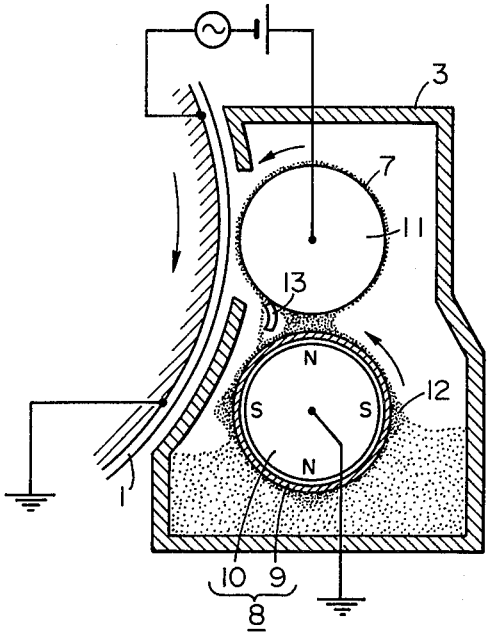
FIG. 2 is a structural diagram of an actual developing device according to the present invention.

FIG. 2 is an actual structural diagram of the developing device according to the present invention, in which a numeral 7 refers to one-component non-magnetic toner, 8 a magnetic roller, 9 a non-magnetic sleeve, 10 a magnet, 11 a developing roller, 12 a magnetic brush, and 13 a scraper.

For the non-magnetic toner, use is made of a powder mixture having a particle size ranging from 7 to 15$\mu$, and consisting principally of 10 parts by weight of carbon, and 90 parts by weight of polystyrene. An appropriate charge controlling agent is further mixed. Iron powder is used for the carrier. The toner and the carrier are mutually subjected to frictional charging by an agitating member (not shown), whereby they are charged in a predetermined polarity in accordance with polarity of the electrostatic image.

The magnetic roller comprises a rotatable non-magnetic sleeve, and a magnet fixedly provided inside this sleeve. It serves to form a magnetic brush consisting of the toner and the carrier to convey both of them. Of course, the same effect can be expected even when the magnet is rotated and the sleeve is fixed.

The arrangement of the magnetic poles of the magnet fixedly provided within the rotatable non-magnetic sleeve is such that, as shown in FIG. 2, one magnetic pole is positioned at a portion confronting to the developing roller, and a conveying magnetic pole is provided at other portions. In the drawing, the arrangement of these magnetic poles is such that the N pole and the S pole are alternately disposed at four positions to divide the sleeve into four equal portions. Each of the magnetic poles is so made that it provides the surface magnetic flux density of approximately 650 gausses on the magnetic roller. It should, however, be noted that the pole arrangement and the magnetic flux density are not limited to the above-described embodiment, but may be an equal division of the sleeve by half, six, eight, etc. Depending on the case, the arrangement may not necessarily be the equal division of the sleeve, e.g., a repulsive pole is provided at a position opposite to the developing roller, and the conveying magnetic pole is provided at the other position. Incidentally, the developing roller and the magnetic brush are held with a space gap therebetween of 0.5 to 10 mm. In the actual embodiment, it is set at 4 mm.

Since there is no possibility of the developing roller being in contact with the electrostatic image holding member at the time of the development as in the conventional developing device, it is not particularly necessary to use a rubbery material rich in pliability for the surface of the developing roller. In the illustrated embodiment, an iron roller is used for the developing roller. In the present invention, since the developing roller and the electrostatic image holding member are kept in a non-contact state, the relative speed between the developing roller and the electrostatic image holding member is not necessarily zero, and the rotational direction between them may be either forward or reverse. Of the toner and the carrier conveyed by the magnetic roller, the toner alone adheres on to the surface of the developing roller at a position where the magnetic roller is in contact with, or in contiguity to, the developing roller due to a composite force of the Vander Waal's force, repulsive force among the toner particles which have been charged in one polarity, and a force of mirror symmetry thereof. The magnetic roller may be rotated in either forward direction or reverse direction with respect to the developing roller, and its rotational speed may not be necessarily equal, but be made variable in accordance with necessity for variation in the toner quantity to be applied to the developing roller. Further, the magnetic roller may be provided in a plurality of stages around the developing roller.

As stated in the foregoing, the toner particles begin to move toward the developing roller due to contact of the magnetic brush to the developing roller surface, whereby a thin toner layer suitable for development is formed on the developing roller as will be described later.

Figure 3:
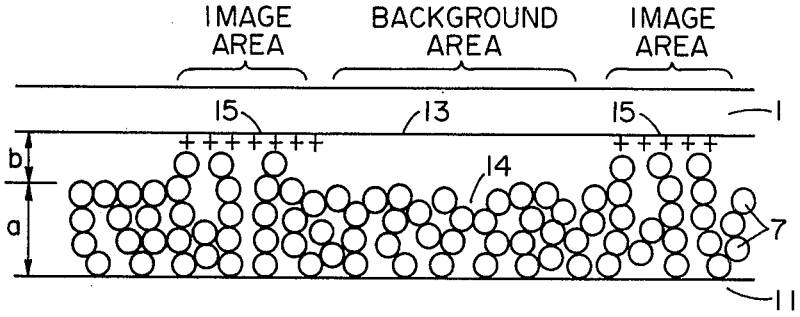
FIG. 3 is a diagram for explaining the state of development of the developing device according to the present invention.

On the other hand, a d.c.-superposed-a.c. voltage is applied across the developing roller and the photosensitive member as shown in the drawing. In case both photosensitive member and magnetic roller are earthed, there is formed a voltage, across the developing roller and the magnetic roller, in the direction to accelerate movement of the toner, so that formation of the toner layer on the developing roller becomes much easier in this case. Needless to say, it is effective to adjust the toner moving quantity from the magnetic roller to the developing roller by further providing an electric bias means. In this instance, an electric field is imparted in the direction of the toner movement from the magnetic roller to the developing roller, depending on the charge polarity of the toner. Furthermore, with a view to maintaining the electric field between the two rollers, an insulating layer is provided on the surface of at least one of these rollers to effectively increase the electric insulation. For example, in other examples of the present invention, when the roller surface of the magnetic brush is covered with a highly resistive material such as silicone rubber and a voltage of 1 to 2 KV is applied across the rollers, there can be obtained the toner layer of 50 to 80$\mu$ thick. For the highly resistive material, there may be used ethylenepropylene rubber, fluorine-containing rubber, natural rubber, polychlorobutadiene, polyisoprene, N.B.R., etc. for positively charging the toner consisting principally of polystyrene, coloring pigment, and so on; and silicone rubber, polyurethane, methylene-butadiene rubber, etc. for negatively charging the toner. In this manner, there can be formed on the surface of the developing toner the toner layer of 30 microns and above in thickness which can be effectively used for the development. The magnetic roller and the developing roller are not limited in shape to those illustrated in the drawing, but various modifications are possible. Now, the toner particles which have moved to the developing roller adhere on the developing roller due to the force of mirror symmetry caused by the electric charge which the toner particles possess, and conveyed to the developing section. FIG. 3 is a schematic diagram for explanation of the state in the developing section. As shown in the drawing, the non-image surface 13 and the toner layer surface 14 are maintained in a non-contact state, while the image surface 15 and the toner layer surface 14 increases thickness of the toner layer in the direction of the electric field in accordance with the electrostatic image on the image portion due to the electric field, and the toner particles on the layer continue to rise from the layer surface and grow in the upward direction as if ears of cereal plants stretch out (this phenomenon will hereinafter be called "toner stretch"). In order that the tip end of the ear of the toner may contact the image surface of the electrostatic image holding member, a space gap b is formed beforehand between the electrostatic image holding member and the toner layer surface.

In this manner, since the space gap between the electrostatic image holding member and the developing roller are so maintained that the toner layer may bring about the "toner stretch" at the image portion, and the tip end of the thus stretched ear of the toner may directly contact the image surface, there is no possibility of lateral flow of the toner particles during their flight due to air current, etc. or instability in the toner particle movement such as deviation of the touch-down points of the toner particles due to vibrations, etc., as is the case with the conventional jumping development, wherein the toner is caused to fly to the image surface for the development. Consequently, the developing device according to the present invention perfectly removes apprehension of lowering in the image quality due to instability of the toner particle movement. In addition, since the toner layer does not contact the non-image portion as mentioned in the foregoing, no fogging whatsoever occurs at this non-image portion. Therefore, in comparison with the image obtained by the conventional indiscriminate contact developing system, the present invention can provide the image of extremely favorable quality. Incidentally, while the degree of the toner stretching depends on the property of the toner particles and other related conditions, such toner stretching can always take place irrespective of such various conditions. In particular, the electrostatic holding of the toner particles is effective from the standpoint of the electrostatic control of the toner. In the case of the toner particles for ordinary use, the effective utilization of the "toner stretching" can be realized when the space gap b between the abovementioned electrostatic image holding member surface and the toner layer surface is maintained less than 10 times of the toner layer thickness a. By the way, explanations will be given hereinbelow as to a case where the tip end of the toner does not contact the image surface of the electrostatic image holding member at the developing section, in spite of the toner particles having been stretched out of the toner layer surface, e.g., a case wherein the space gap between the toner layer and the electrostatic image holding member surface is maintained more than ten times of the toner layer thickness. In this case, clarity of the image lowers at the edge of the image portion to cause a problem of thinning of a line, along with deterioration in the image tonality.

In order to eliminate the abovementioned defect, a low frequency electric field may be imparted to the space gap for the development. In other words, an AC voltage is imparted across the developing roller and the electrostatic image holding member to effect the reciprocating motion of the toner particles to cause equivalent generation of the toner stretching. The frequency is determined by the developing speed. In the commercial reproduction apparatus, the frequency can be made as low as a few tens of hertz to obtain a good image free from irregularity in development. The alternating current waveform need not be only sinusoidal, but also may be rectangular or triangular. The waveform is also not necessarily symmetrical. Further, when the abovementioned AC bias voltage is applied, there occurs, from time to time, equivalent generation of the toner stretching even at the non-image surface, causing the ground fogging. In this instance, a DC voltage may be applied to the a.c. bias voltage. According to the embodiment of the present invention, when the development is effected by rotating the developing roller at a constant speed in the forward direction with respect to the electrostatic image holding member which moves at a speed of 180 mm/sec., the space gap between the developing roller and the electrostatic image holding member is maintained at 300 microns to form the toner layer of approximately 80 microns thick on the developing roller, to which a voltage having its peak value of +700 V and −200 V as obtained by adding a direct current component of 250 V to a voltage having the frequency of 200 Hz and a peak value of ±450 V is applied as an alternating current waveform, whereupon a good image free from the fogging and good tonality can be obtained.

The relationship between the image density and the toner thickness is applicable to the toner particles of 4 to 10 microns in diameter which is usually used. While, up to a particle size of 30 microns or in its vicinity, the density of the developed image is greatly affected with respect to variations in thickness of the toner layer, it tends to be saturated with a particle size of above 30 microns.

Accordingly, with a particle size of 30 microns or below, the image density is unstable, which makes it indispensable to control the toner layer so as to maintain its uniform distribution, while, with the particle size of 30 microns or above, favorable image density can be readily obtained.

On the other hand, with the particle size of 100 microns or above, a substantially saturated state of the image density has been reached already, hence no problem occurs with respect to the image density. Consequently, for adjustment of the space gap between the electrostatic image holding member surface and the developing roller, the toner layer thickness in this range can be arbitrarily used. However, increase in the toner layer thickness invites increase in quantity of the toner to be replenished, so that, from the standpoint of economy and easiness in operation, image development with the toner having the particle size of 100 microns or below is preferable.

The surface of the developing roller which has thus completed the developing operation is once subjected to removal by a scraper 13 of the toner remaining thereon. Although this toner removal is not always necessary, such toner removal on the developing roller surface after the development makes it possible to effect sufficient and uniform toner application thereonto by the magnetic brush in the subsequent step, and to prevent a sleeve roller ghost from occurring, which emerges from time to time in the subsequently developed image due to presence of the residual toner in the previous cycle. A preferred material for the scraper is a thin metal leaf such as, for example, phosphor bronze of 0.1 to 0.2 mm thickness, or a rubber plate such as, for example, urethane rubber, etc. having a rubber hardness of from 60 to 90.

Figure 4:
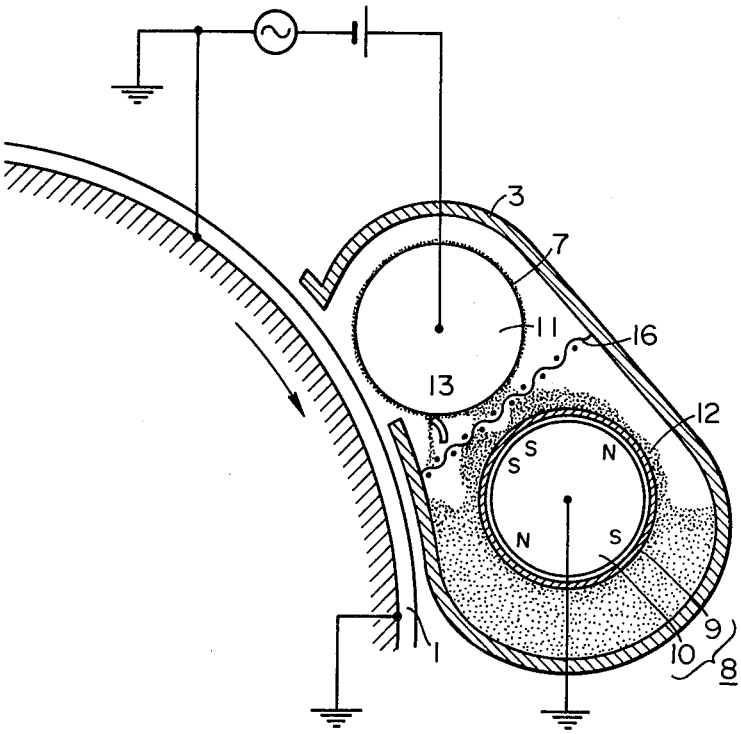
FIG. 4 is a modified structural diagram of the developing device according to the present invention.

FIG. 4 is a schematic diagram for explaining a modified embodiment of the developing device according to the present invention, in which the same reference numerals designate the same members as in the device shown in FIG. 2. In the drawing, a reference numeral 16 designates a screen mesh which is provided for preventing the carrier from the magnetic brush from scattering. Therefore, this screen mesh, while it permits passage of the toner from the magnetic brush to the developing roller surface, does not allow the carrier to pass through it. The wire number of the screen mesh is determined by the particle size of the toner and the carrier. In the commercial electrophotographic reproduction apparatus, it should properly be 50 to 500 meshes, or more preferably, from 150 to 300 meshes. In the embodiment of the present invention, the screen mesh of stainless steel having the mesh size of 250 meshes for use with the carrier of an average size distribution of 150 microns and the toner of an average size distribution of 10 microns. This screen mesh besides being manufactured by mutually weaving yarns in warp and weft, may also be produced by coating a photosensitive liquid on a metal plate, then photographically baking a predetermined mesh pattern thereon to form a photo-resist, and etching the same to form a desired screen mesh. It is also possible to apply a voltage to the screen mesh. For instance, in the case of the polarity of the toner being negative (−), a voltage of −1 to −2 KV is applied to the screen mesh, whereupon movement of the toner particles to the developing roller can be effected satisfactorily, and the toner layer thickness can be made to 80 microns or so. It is, of course, possible to obtain the toner coating layer of 30 microns or so with the grounding alone, because a developing bias voltage is applied to the developing roller. Further, it may be feasible that the screen mesh is made of the same material as that of the carrier so as to give sufficient frictional charge to the toner by collision between the magnetic brush and the screen mesh. It is also feasible to have the screen mesh made of an insulating material such as, for example, Teflon, Nylon, Tetron, Polyester, and other commercially available materials so as to maintain electrical insulation between the developing roller and the magnetic brush. In the case of the polarity of the toner being negative, the frictional charging of the toner can be done satisfactorily with use of the Nylon screen mesh. Teflon, and others are preferable for the toner with the positive polarity.

Figure 5:
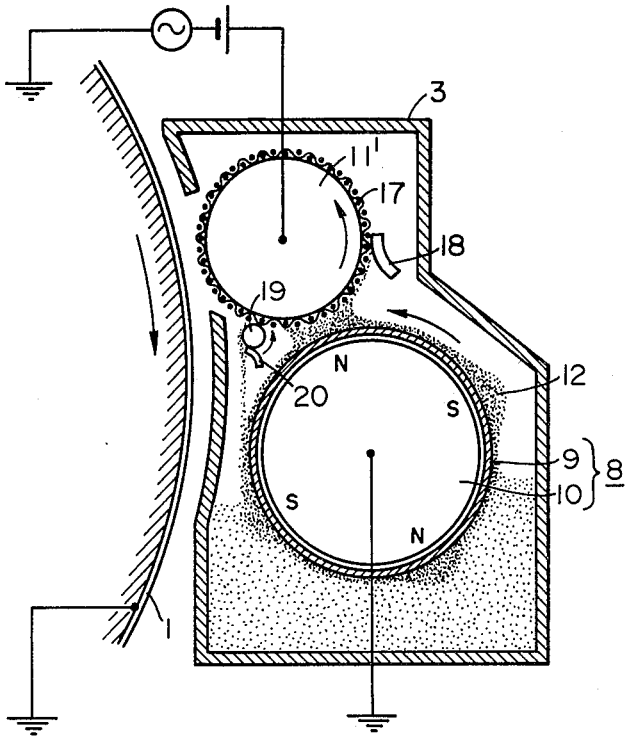
FIG. 5 is another modified structural diagram of the developing device according to the present invention.

FIG. 5 is a further modification of the developing device according to the present invention, wherein the same reference numerals designate the same members as in those of other embodiments.

For the developing roller, use is made of an aluminum roller 11' for the purpose of holding the toner thereon, the surface of which is covered with a Nylon net 17 having a mesh size of 200 meshes, a thread diameter of 50 microns, and a rate of opening of 40% so as to provide tiny holes on the surface of the developing roller. A numeral 18 refers to a doctor blade for adjusting the toner layer thickness. 19 designates a bias voltage applying roller to remove the residual toner on the developing roller after the development, and 20 a scraper for scraping the toner off the developing roller surface. When the image development is effected by maintaining the space gap of 200 microns between the mesh surface of the developing roller and the photosensitive drum surface, and then applying to the developing roller a low frequency electric field having a DC voltage of 250 V superposed on AC voltage of 500 V and having frequency of 300 Hz, there can be obtained an image free from the fogging and having good tonality. In case the screen mesh is electrically conductive, the toner moves to the photosensitive drum with a relative low electric field, since the electrode is in close proximity to the toner at the time of the development.

On the surface of the abovementioned developing roller, there exist a multitude of tiny holes, into which the charged toner particles from the magnetic roller are properly received, whereby a copy having satisfactory image density can be obtained. In the conventional device which does not adopt the concept of the present invention, when the toner is supplied to the developing roller surface from a hopper, and then rubbed by a frictional charging member, the toner particles in the holes are not charged, and the resulting copy is inevitably thin in its image density. In the above-described developing roller, when at least a part of the surface of the developing roller is made of an insulating material so as to maintain insulation between the developing roller and the magnetic brush roller, e.g., when the particle size of the iron powder carrier is such that it cannot get in the tiny holes on the developing roller surface, if the magnetic brush and the electrostatic image holding member are maintained at an equi-potential, and then an AC bias added with the abovementioned DC component is applied to the developing roller, the toner particles move efficiently from the magnetic brush to the developing roller.

Figure 6:
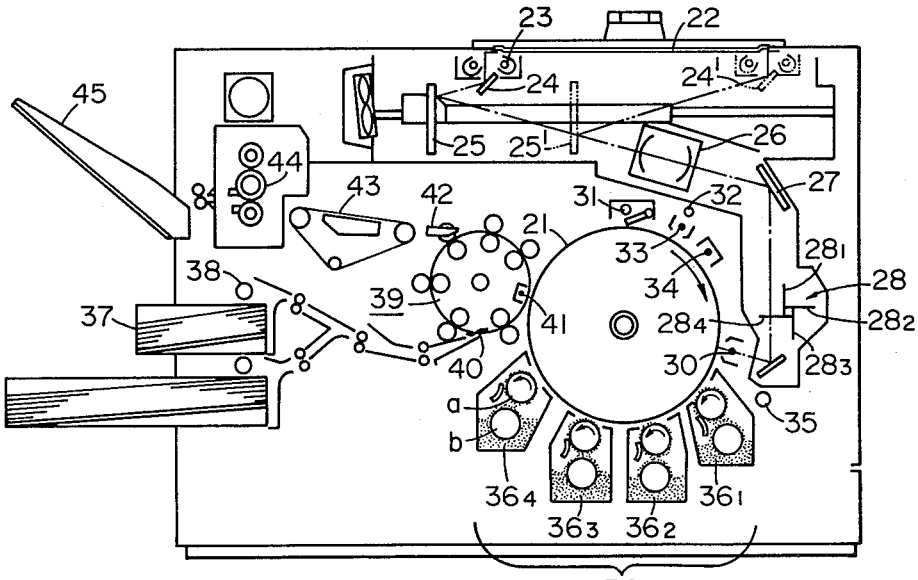
FIG. 6 is a side elevational view, in cross-section, showing an actual color image forming device, in which the developing device of the present invention is incorporated.

FIG. 6 shows a concrete construction of a color image forming apparatus, to which the developing device according to the present invention is applied.

The photosensitive drum 21 is essentially composed of an electrically conductive layer, a photoconductive layer, and an insulative layer.

An image original to be reproduced is placed on the image original mounting glass table 22, and is subjected to irradiation by an illuminating lamp 23. Scanning mirrors 24, 25 scan the image original in synchronism with rotation of the photosensitive drum 21, and move to positions 24', 25'. At this time, the illuminating lamp 23 also moves up to a position 23'.

A light image of the image original which has been scanned is further exposed on the surface of the photosensitive drum through the lens 26, the mirror 27, a color separation means 28, and the mirror 29, and further through the simultaneous exposure and charge removing device 30. The color separating means 28 is provided in a manner so that any of the blue filter $28_1$, green filter $28_2$, red filter $28_3$ and ND filter $28_4$ may be used in a switchable manner.

On the other hand, the surface of the photosensitive drum 21 is cleaned beforehand by the blade cleaner 31, and then the influence of the previous latent image is removed by the pre-exposure lamp 32 and the pre-charge remover 33. Furthermore, the surface of the photosensitive drum surface 21 is uniformly charged by the primary charger 34, and then subjected to the charge removal by the simultaneous exposure and charge removing device 30 together with the light image exposure of the image original. Subsequently, the overall surface exposure is effected by the overall exposure light source 35, whereby an electrostatic latent image of high image contrast is formed on the surface of the photosensitive drum.

Next, the development of the latent image is effected by a predetermined unit of the developer 36 having a plurality of developing units which supply yellow color developer $36_1$, magenta color developer $36_2$, cyan color $36_3$, and black color developer $36_4$. Each of the developing units is of the construction of the developing device according to the present invention, and has the developing roller a and the magnetic roller b.

On the other hand, the image transfer material 37, on which the developed image is transferred, is forwarded to the image transfer unit 39 by means of the paper forwarding roller 38. The image transfer unit 39 has the gripper 40 which holds the image transfer material by gripping the tip end of the image transfer material 37. The image transfer material 37 is subjected to the corona discharge from its back surface by means of the image transfer corona discharger 41 provided in the image transfer unit 39, whereby the developed image on the photosensitive member surface is transferred. The image transfer material 37, in the case of the monochromatic copying, is immediately separated from the image transfer unit by the action of the separating pawl 42. In the case of the polychromatic reproduction, however, the gripper 40 of the image transfer unit 39 is not released until the image transfer of the developed image in two or three colors to be reproduced is completed, hence the separating pawl 42 continues to hold the image transfer material in the image transfer unit without releasing the same. In any case, the image transfer material after the separation is led to the heat fixing roller 44 by the conveyor belt 43, whereby the developed image as transferred is heat-fixed. After this image fixing, the image transfer material is discharged into the paper discharging tray 45. On the other hand, the toner remaining on the surface of the photosensitive drum 21 after completion of the image transfer is cleaned by the blade cleaner 31 to be prepared for the subsequent reproduction cycle.

The color developers used in the yellow, cyan, and magenta developer feeding and developing units of the abovementioned developing device are prepared in accordance with the following recipes.

| | |
|---|---|
| Cyan toner | |
| Polyester resin | 94 wt. parts |
| Phthalocyanine blue | 5 wt. parts |
| Charge controller | 1 wt. parts |
| Magenta toner | |
| Polyester resin | 94 wt. parts |
| Rhodamine type rake pigment | 5 wt. parts |
| Charge controller | 1 wt. parts |
| Yellow toner | |
| Polyester resin | 94 wt. parts |
| Hanza yellow | 5 wt. parts |
| Charge controller | 1 wt. parts |

The average particle size of each of the abovementioned toners is 10 microns. Each of these toners is mixed with iron powder carrier, and then coated on the developing roller for the image development through formation of the magnetic brush by the magnetic roller in each developing unit.

As described in the foregoing, since the color image forming apparatus, in which the developing device according to the present invention has been adopted, uses the non-magnetic developer, arbitrary color can be used. In contrast to this, when the conventional jumping development is to be employed, the magnetic developer should be used, in which case the developer assumes a blackish color due to the magnetic material to be mixed in the developer, which is therefore not so suitable as the color developer. According to the present invention, since the abovementioned single component, non-magnetic developer is used for development in the developing mechanism as mentioned above, there can be obtained clear image free from the fogging. The fact that each color-separated image can be obtained without fogging is directly associated with possibility of the faithful color reproduction.

What I claim is:

1. A developing device, in which development is effected by opposing a thin layer of one-component non-magnetic toner particles to an electrostatic image holding member surface with a small space gap therebetween, the device comprising:

magnetic means to form thereon a magnetic brush with a magnetic carrier which electrostatically attracts one-component, non-magnetic toner particles;

means for supplying magnetic carrier and one-component toner particles to said magnetic means;

developer conveying means which passes by said magnetic means and contacts the magentic brush such that one-component toner particles are received on said conveying means, and which passes a developing station where said development is effected; and means for applying a voltage, having AC components, between said magnetic means and said developer conveying means, wherein said voltage is for promoting the movement of toner to said conveying means, without promoting such travel of the carrier.

2. The developing device as set forth in claim 1, wherein said magnetic means comprises a non-magnetic sleeve and a magnet disposed in the interior of said non-magnetic sleeve.

3. The developing device as set forth in claim 1 or 2, wherein said developer conveying means has an electrically conductive roller.

4. The developing device as set forth in claim 3, wherein a screen layer is provided on the surface of said electrically conductive roller for holding said toner thereon.

5. The developing device as set forth in claim 2, wherein an insulative cover layer is provided on the surface of said non-magnetic sleeve.

6. A developing device, wherein development is effected by facing a thin layer of one-component, non-magnetic toner particles to an electrostatic image holding member surface with a very small space gap therebetween, the device comprising:

magnetic means to form thereon a magnetic brush with a magnetic carrier which charges and attracts one-component, non-magnetic toner particles;

means for supplying the magnetic carrier and one-component toner particles to said magnetic means;

developer conveying means which passes through a toner receiving position facing said magnetic means to receive the one-component toner particles, and a developing position facing said electrostatic image holding member surface;

carrier passage inhibiting means which inhibits passage of the carrier, but allows passage of the toner at said toner receiving position where said magnetic means and said developer conveying means confront each other.

7. The developing device as set forth in claim 6, wherein said magnetic means comprises a non-magnetic sleeve and a magnet disposed in the interior of said non-magnetic sleeve.

8. The developing device as set forth in claim 6 or 7, wherein said developer conveying means has an electrically conductive roller.

9. The developing device as set forth in claim 6, wherein said carrier passage inhibiting means has a screen mesh member provided with openings for passing toner particles while inhibiting the passage of said magnetic carrier.

10. The developing device as set forth in claim 6, further comprising a voltage applying means to apply a voltage across said developer conveying means and said electrostatic image holding member.

11. The developing device as set forth in claim 8, wherein a screen layer is provided on the surface of said electrically conductive roller for holding said toner thereon.

* * * * *